United States Patent [19]

Fowler et al.

[11] 4,027,140

[45] May 31, 1977

[54] ELECTRONIC CASH REGISTER

[75] Inventors: Hugh Fowler, Townsend; Murray A. Ruben, Belmont; Richard L. Dumais, Marlborough; Robert F. Collings, Stowe, all of Mass.

[73] Assignee: Data Terminal Systems, Inc., Maynard, Mass.

[22] Filed: Apr. 15, 1975

[21] Appl. No.: 568,285

[52] U.S. Cl. ..... 235/7 R; 235/152

[51] Int. Cl.[2] ..... G07G 1/00

[58] Field of Search ..... 235/156, 164, 7 R, 112, 235/1 E, 2, 152; D26/5 C, 4 A; 340/324 R, 365 R; 200/5 A, 5 R; 317/101 F

[56] References Cited

UNITED STATES PATENTS

| | | | |
|---|---|---|---|
| 3,045,901 | 7/1962 | Allen | 235/2 |
| 3,710,085 | 1/1973 | Brewer et al. | 235/164 |
| 3,911,234 | 10/1975 | Kotaka | 200/5 A |
| 3,925,779 | 12/1975 | Gerstenhaber | 340/324 R |

*Primary Examiner*—Malcolm A. Morrison
*Assistant Examiner*—Errol A. Krass
*Attorney, Agent, or Firm*—Richard J. Birch

[57] ABSTRACT

An electronic cash register having an inverted U-shaped housing with at least two, spaced, downwardly extending side members. A cash till is positioned between the side members of the housing and is movably mounted with respect to the housing. The cash till forms at least a portion of the bottom of the cash register. In the preferred embodiment, the cash register keyboard data entry means, electrical signal processing means and output display means are mounted on and electrically interconnected by a single printed circuit board that is secured with respect to the register housing.

11 Claims, 4 Drawing Figures

ELECTRONIC CASH REGISTER

BACKGROUND OF THE INVENTION

The present invention relates to cash registers in general and, more particularly, to an improved electronic cash register.

In recent years the ubiquitous electromechanical cash register has been replaced gradually with electronic cash registers. Typically, the electronic cash registers have duplicated the general mechanical structure of the electromechanical cash register while providing increased flexibility and functions through the use of electronic data manipulation and visual output display devices. The currently available electronic cash registers employ the mechanical cash drawer arrangement of conventional registers.

In conventional cash registers the cash drawer moves outwardly from the register housing upon the completion of a financial transaction. A removable cash till is positioned within the cash drawer and functions as an initial receptacle for cash received by the register operator. This mechanical arrangement can be viewed as a box (the cash till) within a box (the cash drawer) within a box (the housing of the register). Although the arrangement is functionally satisfactory, it is needlessly complex and expensive to implement.

It is accordingly a general object of the present invention to provide an improved electronic cash register.

It is a specific object of the invention to provide an electronic cash register which utilizes a simpler and less expensive mechanical implementation of the functions performed by the conventional cash register housing, cash drawer and cash till.

It is still another object of the invention to provide an electronic cash register which employs a single printed circuit board for the mounting and electrical interconnection of the register keyboard, signal processing circuits and visual output display devices.

It is a feature of the invention that the use of a single printed circuit board for the main electrical components of the cash register permits a desirable and compact shape factor for the register housing.

It is another feature of the invention that separate customer and operator visual displays can be incorporated in the register by means of the single printed circuit board.

These objects and other objects and features of the invention will best be understood from a detailed description of a preferred embodiment of the invention, selected for purposes of illustration and shown in the accompanying drawings, in which.

Figure 3:
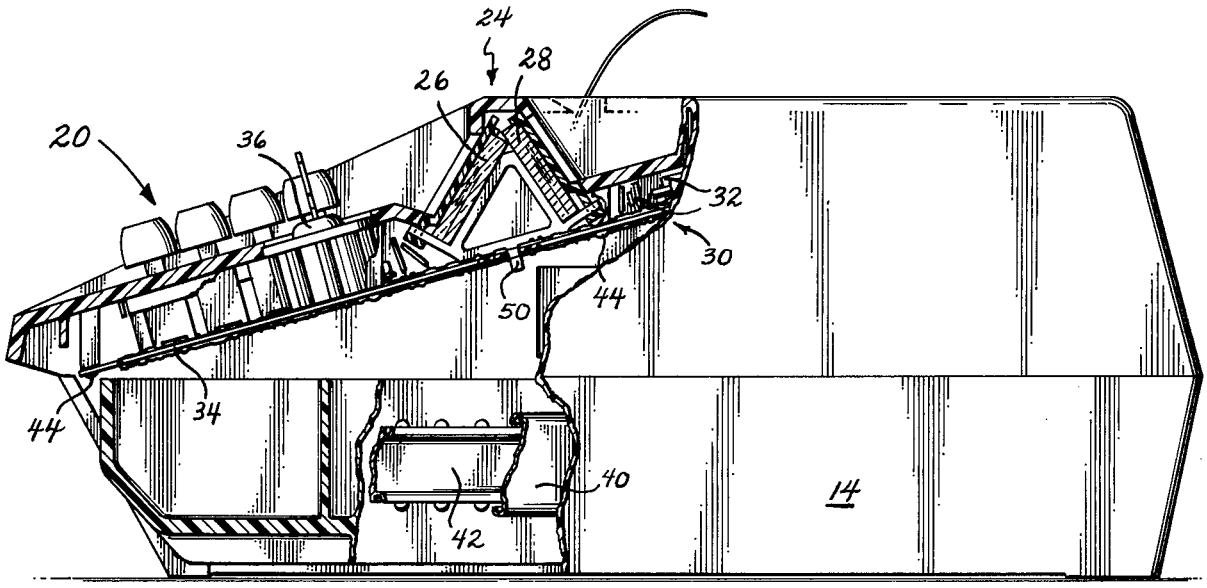
Figure 4:
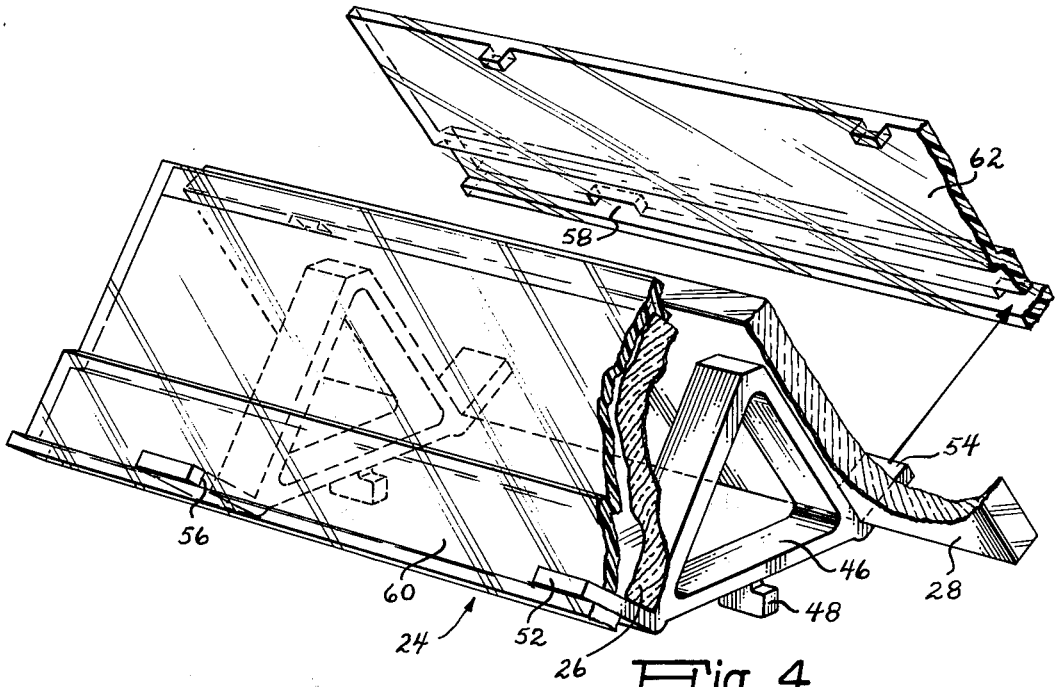

FIG. 3 is a view in side elevation of the electronic cash register with portions thereof broken away to illustrate the cash till, cash till mounting system, the data entry keyboard, the operator and customer visual displays, a portion of the electrical signal processing circuitry and the single printed circuit board; and, FIG. 4 is a partially exploded perspective view of the display assembly for the operator and customer displays.

DETAILED DESCRIPTION OF A PREFERRED EMBODIMENT

Figure 1:
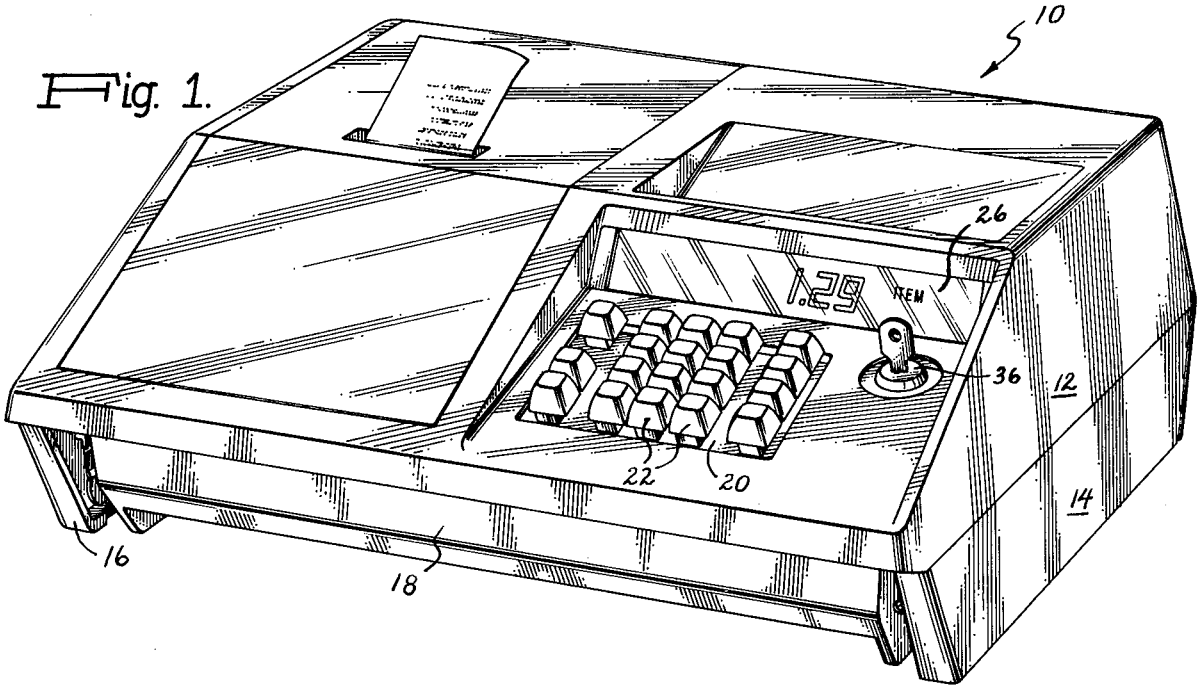
FIG. 1 is a view in perspective of the electronic cash register of the present invention.
Figure 2:
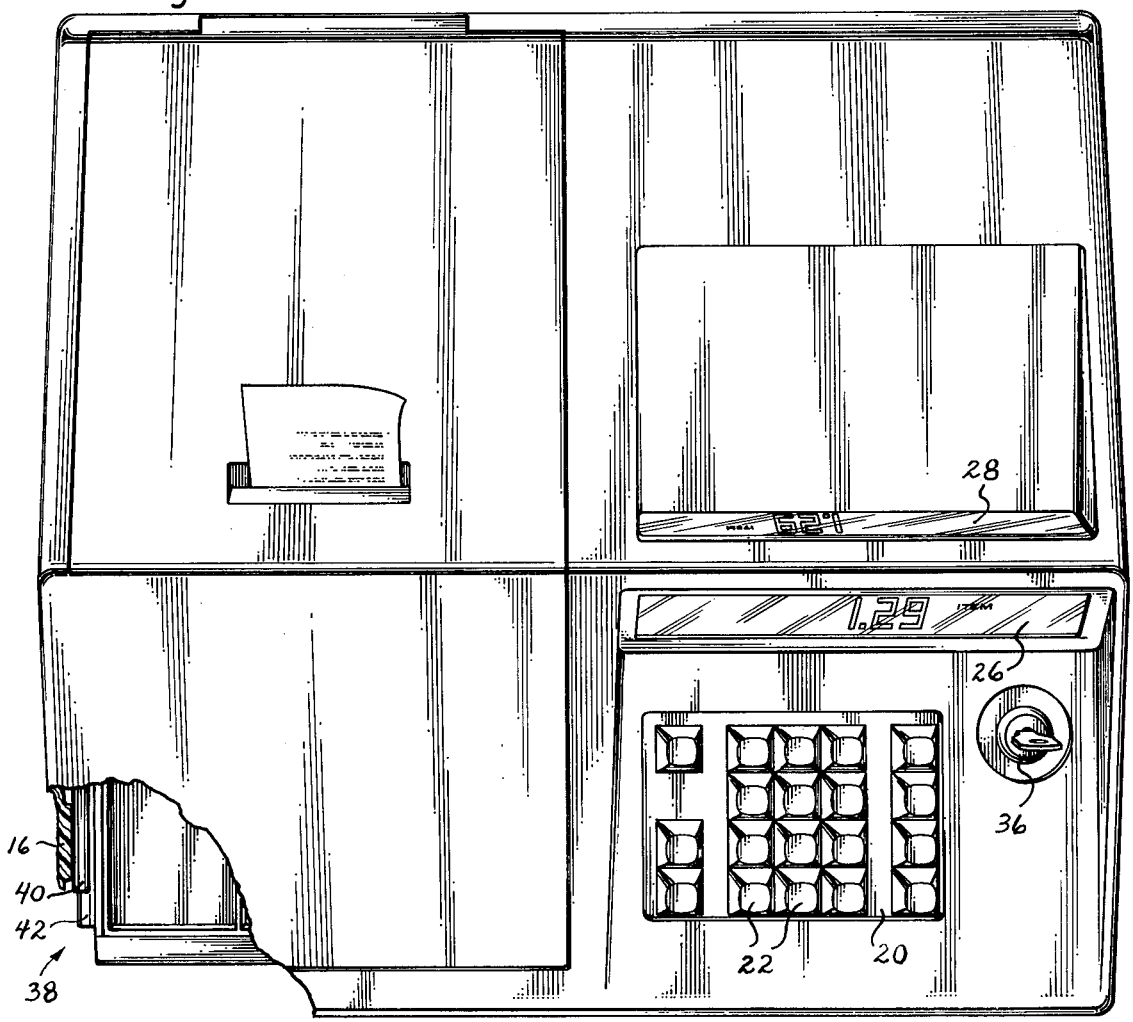
FIG. 2 is a plan view of the electronic cash register.

Turning now to FIGS. 1–3 of the drawings, there is shown an electronic cash register constructed in accordance with the present invention and indicated generally by the reference numeral 10. The major components of the cash register 10 comprise: an inverted U-shaped register housing 12 having at least two spaced, downwardly extending side members 14 and 16; a cash till 18 which is positioned between and movably mounted with respect to the register housing 12; a data entry keyboard 20 having a plurality of data entry, printed circuit board key switches 22; a visual display assembly 24 which includes an operator display 26 and a customer display 28; an electronic signal processing circuit indicated generally by the reference numeral 30, which includes a number of discrete electronic components 32; a single printed circuit board 34 for mounting and electrically interconnecting the data entry keyboard switches, the visual displays and the electrical signal processing components; and, finally a key switch 36.

For purposes of clarity a number of conventional components of an electronic cash register have been omitted from the drawings eg. the electromechanical print mechanism for printing a paper tape record of the sales transaction, the electrical power supply, line cord and the electromechanical kickout mechanism for the cash till. Although these components have not been shown in the drawings, their use and structure is well known to those skilled in the art and a description thereof is not deemed necessary for an understanding of the present invention.

It has already been mentioned that one of the objects of the present invention is to provide an improved electronic cash register in which the cash till 18 forms at least a portion of the bottom of the cash register thereby eliminating the three-fold box-within-a-box configuration of the existing electronic cash registers. In the preferred embodiment this object is accomplished by movably mounting the cash till 18 between the housing side members 14 and 16 with the cash till forming the bottom of the cash register in the area between the side members. The cash till is movably mounted by means of a mounting assembly 38 which comprises ball bearing, double slides 40 and 42, as best seen in the broken away FIGS. 2 and 3. The mounting assembly 38 permits the cash drawer to move relative to the cash register housing in a conventional manner by moving outwardly toward the operator ie. to the left as viewed in FIG. 3. Although this movement is preferable, it will be appreciated that the cash till 18 can remain stationary while a portion of the housing moves to make the cash till accessible to the operator.

The sales transaction data is entered into the electronic cash register 10 through the data entry keyboard 20. The data is represented by the actuation state of one or more of the data entry, printed circuit key switches 22. Actuation of the key switches produces electrical signals representative of the actuation state of each key switch. The electrical signals are processed by conventional electrical signal processing circuitry 30 which produces output signals for actuation of the printer mechanism (not shown) and the operator and the customer displays 26 and 28, respectively.

Referring for a moment specifically to FIG. 3, it can be seen that the data entry keyboard 20, visual display assembly 24 and electrical signal processing circuitry components 32 are all mounted on the single printed circuit board 34 which in turn is secured to the housing 12 by standard fasteners 44. The single printed circuit board 34 serves to electrically interconnect and provides a mounting support for the data entry keyboard, the display assembly and the components of the electrical signal processing circuitry. This configuration permits a desirable shape factor for the electronic cash register 10 and greatly simplifies the wiring of the register with a concomitant reduction in cost of manufacture.

Referring now to FIGS. 1 through 4, the visual display assembly 24 is mounted on the printed circuit board 34 so that the operator display 26 faces toward the operator data entry keyboard while the customer display 28 faces toward the customer and away from the operator. This relationship can best be seen in the plan view of FIG. 2.

Both displays are mounted with respect to the printed circuit board to provide maximum visability for the register operator and customer. In order to achieve this visability without sacrificing the register shape factor, the displays are mounted back-to-back with the planes thereof intersecting at an acute angle. The preferred angular relationships for the printed circuit board and displays can be seen in FIG. 3.

The printed circuit board is mounted within the register housing 12 at an angle of approximately 15° with respect to the horizontal plane (shown in FIG. 3 by the thin double lines). The operator display 26 is mounted with the plane thereof intersecting the vertical at 30° while the customer display plane intersects the vertical at 35°.

Looking at FIGS. 3 and 4, the displays 26 and 28 are supported by triangular support members 46 each of which has a downwardly extending tab 48 that engages a corresponding slot 50 in the printed circuit board. Each support member 46 also has a forwardly extending tab 52 and a rearwardly extending tab 54 which operatively engage corresponding slots 56 and 58 in front and rear display covers 60 and 62, respectively. The display covers 60 and 62 can be screened or otherwise marked with approximate indicia associated with the visual displays eg., "VOID" or "ERROR".

Preferably, the operator and customer displays are substantially planar with the display numerics or alphanumerics being formed by the well known seven segment display. Conventional LED, liquid crystal or gas discharge displays can be used for both the operator and customer displays.

Having described in detail a preferred embodiment of our invention, it will now be apparent to those skilled in the art that numerous modifications can be made therein without departing from the scope of the invention as defined in the following claims.

What we claim and desire to protect by Letters Patent of the United States is:

1. A cash register comprising:

1. a housing having an inverted U-shape with at least two, spaced, downwardly extending side members;
2. a cash till positioned between the side members and movably mounted with respect to the housing said cash till formed at least a portion of the bottom of the cash register;
3. keyboard data entry means having a plurality of actuatable data entry keys;
4. means responsive to the actuation state of said data entry keys for producing a visual representation of the data entered thereby; and,
5. means for mounting said keyboard data entry means and said visual representation producing means with respect to said housing.

2. An electronic cash register comprising:

1. a housing having an inverted U-shape with at least two, spaced, downwardly extending, side members;
2. a cash till positioned between the side members and movably mounted with respect to the housing, said cash till forming at least a portion of the bottom of the electronic cash register;
3. keyboard data entry means having a plurality of actuatable data entry keys for producing electrical signals representative of the actuation state of each data entry key;
4. electrical means for processing said electrical signals to produce output signals;
5. display means responsive to said output signals for producing a visual representation thereof; and,
6. means for mounting said keyboard data entry means, electrical means and display means with respect to said housing.

3. The electronic cash register of claim 2 wherein said display means is mounted with respect to said housing and keyboard data entry means so that the display means is visible to an operator of the keyboard data entry means.

4. The electronic cash register of claim 2 further comprising a second display means responsive to said output signals for producing a visual representation thereof, said second display means being mounted with respect to said housing and keyboard data entry means so that the second display means is invisible to an operator of the keyboard data entry means at a first position, but is visible to a customer at a second position.

5. The electronic cash register of claim 4 wherein said display means and said second display means face in opposite directions with the display means facing the keyboard data entry means.

6. The electronic cash register of claim 5 wherein said display means and said second display means are substantially planar and are mounted back-to-back with the planes thereof intersecting at an acute angle.

7. The electronic cash register of claim 2 wherein said keyboard data entry means, electrical signal processing means and display means are mounted on and electrically interconnected by a single printed circuit board.

8. The electronic cash register of claim 2 wherein said keyboard data entry means, electrical signal processing means and display means are mounted on and electrically interconnected by a single printed circuit board, said printed circuit board being secured with respect to the cash register housing.

9. The electronic cash register of claim 8 further comprising a second display means mounted on and electrically interconnected by said printed circuit board with the electrical signal processing means.

10. The electronic cash register of claim 9 wherein said display means and said second display means face in opposite directions with the display means facing the keyboard data entry means.

11. The electronic cash register of claim 10 wherein said display means and said second display means are substantially planar and are mounted back-to-back with the planes thereof intersecting at an acute angle.

* * * * *